US005555005A

United States Patent [19]

Pagnon

[11] Patent Number: 5,555,005

[45] Date of Patent: Sep. 10, 1996

[54] ELECTRONICALLY CONTROLLED PNEUMATIC PRESSURE REGULATOR AND METHOD FOR THE REGULATION OF THE PRESSURE OF A FLUID USING SUCH A REGULATOR

[75] Inventor: Alain Pagnon, Bourg les Valence, France

[73] Assignee: Imaje, Bourg les Valence, France

[21] Appl. No.: 120,964

[22] Filed: Sep. 15, 1993

[30] Foreign Application Priority Data

Sep. 15, 1992 [FR] France ..... 92 10993

[51] Int. Cl.[6] ..... B41J 29/38

[52] U.S. Cl. ..... 347/6; 347/84; 137/12

[58] Field of Search ..... 347/6, 17, 84, 347/85; 137/12, 14, 81.1, 206

[56] References Cited

FOREIGN PATENT DOCUMENTS

| | | |
|---|---|---|
| 0142264 | 5/1985 | European Pat. Off. . |
| 0354715 | 2/1990 | European Pat. Off. . |
| 0362101 | 4/1990 | European Pat. Off. . |
| 2275822 | 1/1976 | France . |
| 2618727 | 2/1989 | France . |
| 2652540 | 4/1991 | France . |
| WO89/00308 | 1/1989 | WIPO . |
| WO91/17052 | 11/1991 | WIPO . |

*Primary Examiner*—John E. Barlow, Jr.
*Attorney, Agent, or Firm*—William L. Feeney; Kerkam, Stowell, Kondracki & Clarke, P.C.

[57] ABSTRACT

An accumulating chamber has its fluid pressure regulated between the pressure of a given source pressure value and a discharge pressure value. Electronic control of the accumulating chamber pressure is accomplished by a regulator having a transfer volume and first, second, and third solenoid valves. The transfer volume is connected to the accumulating chamber by the first solenoid valve. The second solenoid valve connects the transfer volume to a pressure source at the given source pressure value. A third solenoid valve connects the transfer volume to open air. A pressure sensor measures the pressure in the accumulating chamber and is connected to an electronic control system.

10 Claims, 3 Drawing Sheets

| 1 | 2 | 3 |
|---|---|---|
| F | F | F |
| O | F | F |
| F | F | F |
| F | F | O |
| F | F | F |

| 1 | 2 | 3 |
|---|---|---|
| F | F | F |
| F | O | F |
| F | F | F |
| F | F | O |
| F | F | F |

FIG. 4
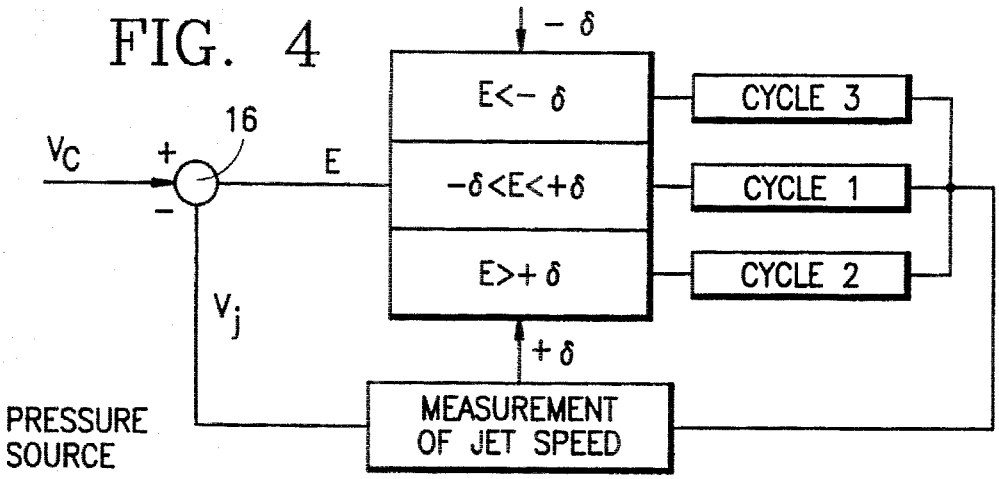
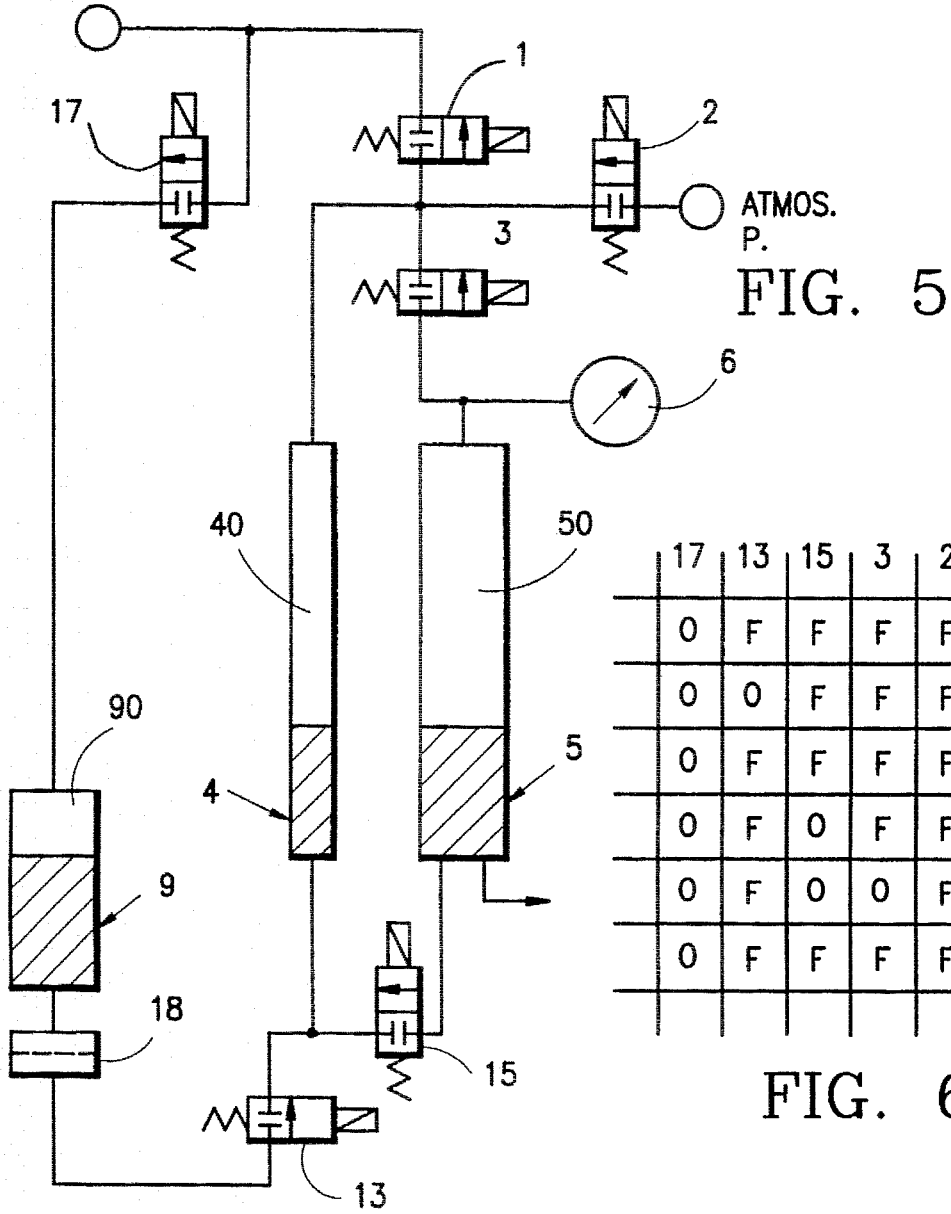
FIG. 5
| 17 | 13 | 15 | 3 | 2 | 1 |
|---|---|---|---|---|---|
| O | F | F | F | F | F |
| O | O | F | F | F | F |
| O | F | F | F | F | F |
| O | F | O | F | F | F |
| O | F | O | O | F | F |
| O | F | F | F | F | F |
FIG. 6

ELECTRONICALLY CONTROLLED PNEUMATIC PRESSURE REGULATOR AND METHOD FOR THE REGULATION OF THE PRESSURE OF A FLUID USING SUCH A REGULATOR

BACKGROUND OF THE INVENTION

1. Field of the Invention

The invention relates to an electronically controlled device and method for the regulation of pneumatic pressure and to their use in a system for the servocontrol of the speed of the jets coming from a liquid spraying head.

A special application of the invention is that of printing by a continuous jet of ink drops that have to be brought, under constant and precise pressure, in the modulation body of a printer towards a calibrated nozzle.

2. Description of the Prior Art

At present, there are two types of electronically controlled pressure regulators: membrane type regulators and specialized solenoid-valve regulators for which the pressure regulation is obtained by the mechanical equilibrium of a part in motion (membrane-piston)

In an electronically-controlled membrane type regulator, the force that is applied to the membrane is due not to a spring as in a manual control but to an air pressure, obtained by means of a pneumatic potentiometer. The value of the pressure thus regulated ranges from a higher value, called an input pressure, given by a source, and a lower value, called an output or discharge pressure, which is generally the atmospheric pressure. The potentiometer is constituted by an electronic device that incorporates the regulation loop, associated with a nozzle-blade system or with two proportional solenoid valves, or again with a three-way, three-position solenoid valve with high-speed opening and shutting, according to the chosen technology.

In the second type of electronically controlled pressure regulator, the solenoid valve is a three-way solenoid valve receiving an electrical control signal delivered by an electronic regulation device as described in the French patent application FR 2 275 822 by HOERBIGER and the European patent application EP 328 573 by JOUCOMATIC. As a function of this electrical control signal and of the value desired for the regulated pressure, a piston internal to the valve takes different positions providing either for a link between the source pressure and the regulated pressure when the latter is too low with respect to the desired value or for a link between the discharge pressure and the regulated pressure when this regulated pressure is greater than the desired value, or for an imperviousness of the regulated pressure with respect to the source pressure and the discharge pressure.

These electronically controlled pressure regulators firstly are far more costly than manually controlled ones and, secondly, have certain drawbacks such as sensitivity to pollution which dictates intensive filtering in the case of the nozzle-blade system or the oversizing of the elements for systems that require only a small flowrate of air, such as ink-jet printers. Furthermore, the overall efficiency of the pressure regulation system is poor for a requirement of low flowrate since presently used regulators always consume a small amount of air even when the demand is zero. This means that it is necessary to choose the dimensions of the compressor as a function of the consumption of the regulator and not as a function of effective demand. In addition to these drawbacks, there are the problems of hysteresis due to the friction of the moving parts and the problems of instability of the pressure source.

In the field of the invention as used in ink-jet printers, the qualities of printing are closely related to the speed at which the ink is ejected by the nozzles. Now, this speed may be reduced by variations in the pressure of the ink upstream with respect to the these ejection nozzles. Hence, the pressure of the ink should be constantly checked and controlled with high precision. The published French patent application FR 2,652,540 filed on behalf of the applicant, describes a use of compressed air to pressurize the ink circuit of an ink-jet printer, with a manually controlled pressure regulator. The circuit for the supply of ink to the printer, described in this patent application, includes an ink accumulating chamber designed to spray an ink jet to the ejection nozzles. The transfer of ink into this accumulating chamber is done by completely emptying a viscosimeter which is filled with ink from a recovery vessel that is itself connected to an ink container and a solvent container and that checks the viscosity of the ink for the printing. The level of pressure in the accumulating chamber is measured by a needle manometer and this pressure is regulated by a manually controlled regulator that acts on a conduit for the inlet of the pressure given by a compressor. The emptying of the ink from the viscosimeter into the accumulating chamber is done through a calibrated outlet that is dimensioned to limit the ink transfer flowrate in accordance with the response rate of the regulator which should be capable of swiftly dealing with any tendency towards overpressure that would be caused by a sudden arrival of ink in said accumulating chamber.

SUMMARY OF THE INVENTION

The object of the present invention is to overcome these different drawbacks by proposing a pressure regulator provided with an intermediate volume between the source pressure, the discharge pressure and the pressure of the outlet volume.

According to the invention, an electronically controlled pressure regulator for regulating the pressure of the fluid contained in an accumulating chamber between a higher value delivered by a given pressure source and a lower value, called a discharge pressure value, wherein said regulator comprises:

a transfer volume, connected to the accumulating chamber by a first electronically controllable solenoid valve;

a second electronically controllable solenoid valve connecting the transfer volume to the pressure source;

a third electronically controllable solenoid valve connecting said transfer volume to a pressure well;

a pressure sensor, located downstream with respect to the first solenoid valve, measuring the pressure of the fluid in the accumulating chamber and being connected to an electronic control system of the solenoid valves.

A pressure regulator according to the invention will advantageously be used in the servocontrol of the speed of a liquid spraying head, especially for an ink jet printer.

BRIEF DESCRIPTION OF THE DRAWINGS

Other features and advantages of the invention shall appear from the following description of a particular exemplary embodiment, said description being made with reference to the drawings, of which:

FIG. 4 is a diagram showing the principle of the servo-control of the speed of the jet, according to the invention;

FIG. 5 is a diagram showing the principle of the transfer of ink into the accumulating chamber according to the invention;

FIG. 6 shows the basic sequence of operation of the solenoid valves of the regulator according to the invention, during the transfer of the ink.

The elements bearing the same references in the different figures fulfil the same functions with a view to obtaining the same results.

MORE DETAILED DESCRIPTION

Figures 1, 2A, 2B:
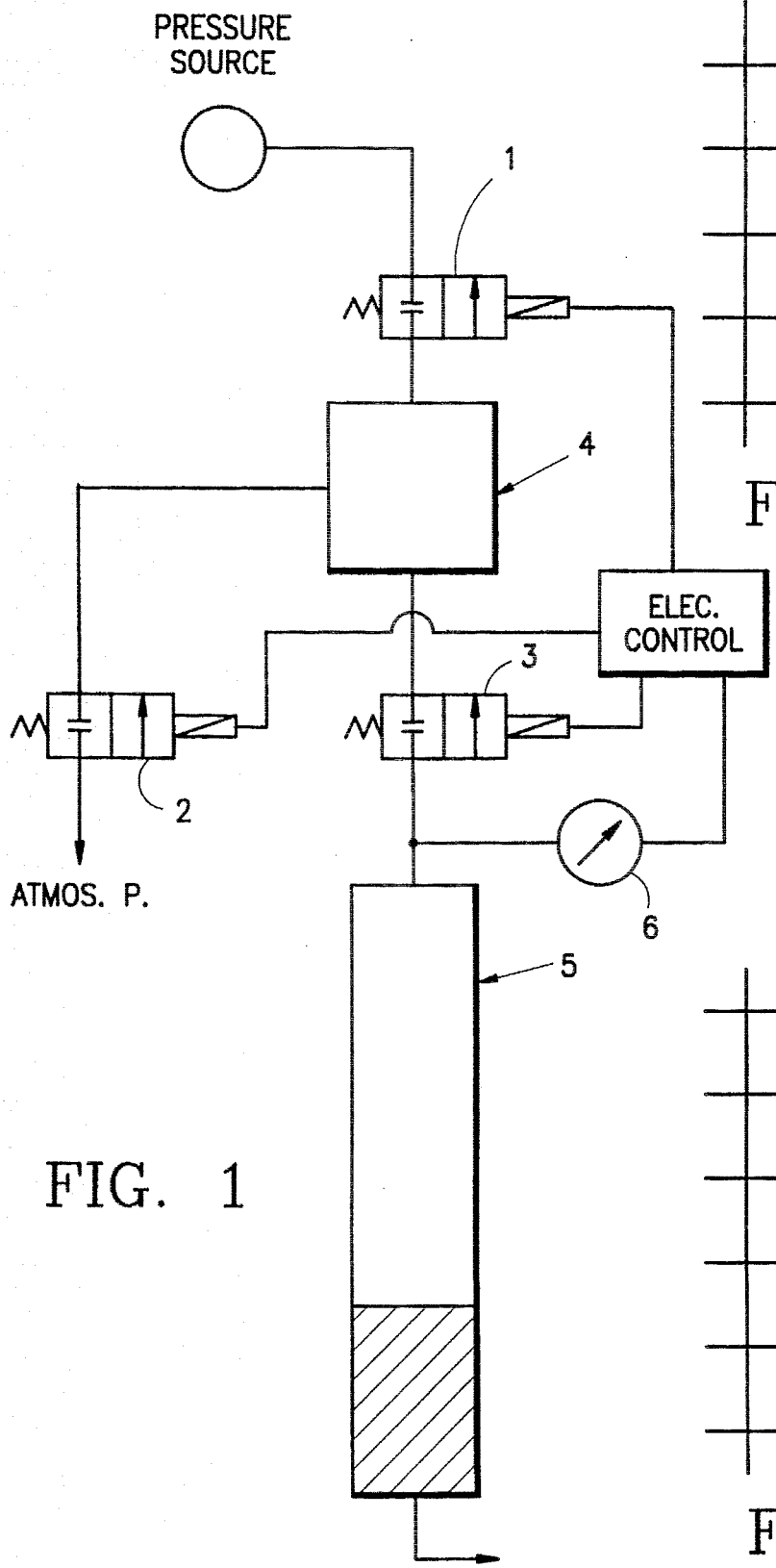
FIG. 1 is a drawing of an electronically controlled pressure regulator according to the invention.
FIGS. 2A and 2B show the sequences of operation of the solenoid valves of the regulator according to the invention, relating to pressure variations.

FIG. 1 is a diagram showing the principle of the pressure regulator according to the invention, designed for regulating the pressure of a fluid, for example a diphasic fluid, contained in an accumulating chamber 5. This pressure regulator comprises a transfer volume 4, connected to its environment by three two-way, two-position solenoid valves 1, 2 and 3. This transfer volume 4 is thus connected, by the solenoid valve 1, to a pressure source, a compressor for example, designed to enable the volume 4 to be pressurized to a pressure of the order of four relative bars for example. The transfer volume 4 is also connected to a pressure well delivering a pressure lower than the pressure of the accumulating chamber 5 (open air for example) by means of a solenoid valve 2, so that it can be put under atmospheric pressure. Finally, the volume 4 is connected, by the solenoid valve 3, to the outlet volume 5, called an accumulating chamber. A pressure sensor 6, placed at the inlet of the accumulating chamber 5, delivers information elements, processed by the electronic control system of the solenoid valves, on the value of the pressure prevailing in the accumulating chamber 5, and makes it possible to ascertain that the regulator is working properly.

This volume of air 4, which is an intermediate volume between the pressure source, the discharge pressure and the outlet volume, is sized precisely as a function of this source pressure, the discharge pressure, the pressure in the accumulating chamber 5 and the precision required with respect to the regulation of this last-named pressure. In order that the transfers between the volume 4 and the accumulating chamber 5 may not give rise to substantial disturbances, in accordance with the precision sought for the regulator, the transfer volume 4 is low as compared with the outlet volume. The frequency of the transfers is a function solely of the air flow rate required at the outlet.

With the liquid jet sent out at the outlet of the accumulating chamber 5 being stopped, the operation of the regulator is checked as follows: the solenoid valves 2 and 3 are activated to be open, thus putting the accumulating chamber 5 into a state of direct communication with the pressure source. The level of the pressure source can thus be checked by means of the pressure sensor 6. Then, the opening of the solenoid valves 2 and 3 is activated to put the accumulating chamber 5 into a state of direct communication with the atmosphere, and to ascertain that the accumulating chamber 5 has been placed under atmospheric pressure through the detection of a zero relative pressure by means of the sensor 6.

The method of regulation of the pressure in the accumulating chamber 5 comprises three basic cycles.

The first cycle corresponds to the case where the pressure in the accumulating chamber is within the range of values desired, for example 3 bars plus or minus 1%. No sequence is then initialized, and all three solenoid valves remain closed.

The second cycle corresponds to the case where the pressure read in the accumulating chamber 5 is lower than the values of the required range. A sequence shown in FIG. 2A, for the increasing of the pressure in the accumulating chamber 5, is then launched and consists:

in a first step, in placing the transfer volume 4 at the source pressure, by the opening of the solenoid valve 1, the solenoid valves 2 and 3 being closed;

in a second step, in isolating the transfer volume 4 by closing all the solenoid valves;

in the third step, in placing the transfer volume 4 in a state of communication with the accumulating chamber 5, by opening the solenoid valve 3, the solenoid valves 1 and 2 remaining closed;

in a fourth step, with all three solenoid valves being closed, in taking account of the pressure signal from the sensor 6 by means of the electronic control system 60 of the printer to reiterate the above-described cycle until the desired pressure is obtained in the accumulating chamber 5. This electronic system is used, in particular, to activate the opening and closing of the solenoid valves to ensure that the jets have the right speed.

The third cycle corresponds to the case where the pressure read in the accumulating chamber 5 is greater than the values of the required range. In this case, a pressure-lowering sequence shown in FIG. 2B, is launched and consists:

in a first step, in placing the transfer volume 4 at the discharge pressure, by the opening of the solenoid valve 2, the solenoid valves 1 and 3 remaining closed;

in a second step, in isolating the transfer volume 4 by closing all the solenoid valves;

in the third step, in placing the transfer volume 4 in a state of communication with the accumulating chamber 5, by opening the solenoid valve 3, the solenoid valves 1 and 2 remaining closed;

in a last step, with the solenoid valves 1, 2, 3 being closed, in taking account of the pressure signal from the sensor 6 by means of the electronic control system, to reiterate this sequence until the required pressure is obtained in the accumulating chamber 5. Thus, the pressure in said accumulating chamber falls, and is reset within the required range.

Figure 3:
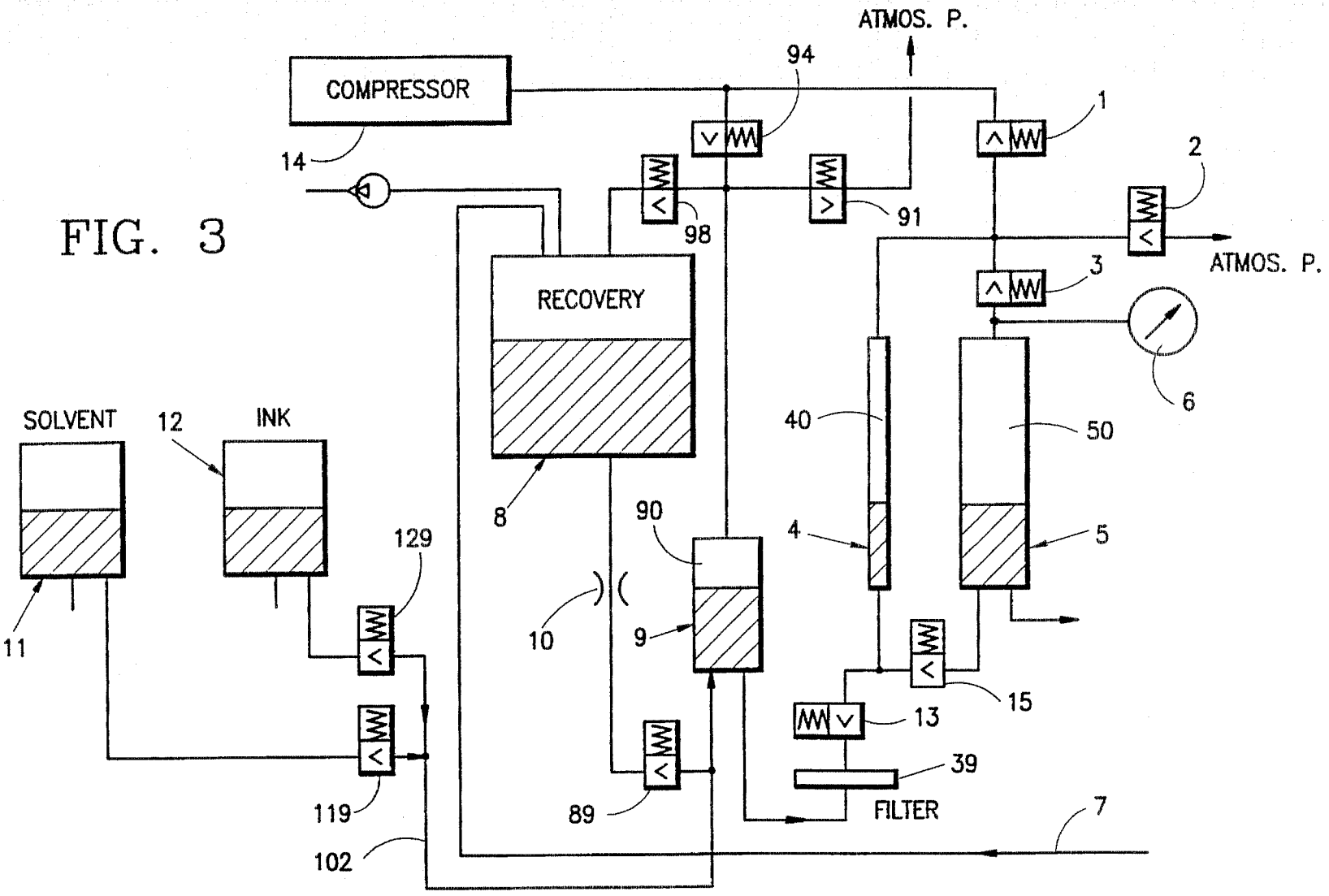
FIG. 3 is a hydraulic diagram of an ink jet printer fitted out with a pressure regulator according to the invention.

FIG. 3 relates to the application of the invention to printing by continuous jets of liquid drops, notably ink drops, and shows the hydraulic diagram of an ink jet printer fitted out with a regulator according to the invention.

The accumulating chamber is used as a container of ink for printing on a medium with drops by means of a printing head (not shown) of the printer. The pressure of the ink is given by a volume of gas 50 over the ink. The unused drops of ink are recovered at the outlet of the printing head and recycled by a conduit 7 towards a vessel 8 called a recovery vessel, used as an intermediate vessel between an ink container 12 and the accumulating chamber 5. For this purpose, the vessel 8 is placed in a state of depression by a depression circuit as described in the published French patent application 2 652 540, filed on behalf of the present Applicant. A viscosimeter 9, designed to measure the viscosity of the ink coming from this recovery vessel 8, is used as a container through which there flows the ink coming from said recovery vessel 8 before it is sent into the accumulating chamber 5. This viscosimeter is connected to the lower part of the vessel 8 by means of a solenoid valve 89 through a calibrated outlet 10, and the lower part of the transfer volume 4 by a solenoid valve 13, after passing through a filter 39, preventing this solenoid valve 13 from being clogged with particles in suspension in the ink. Depending on the measurement of the viscosity, solvent contained in a container 11 may be added to the viscosimeter 9 by means of a solenoid valve 119. Furthermore, the volume of gas 90 prevailing in the viscosimeter is connected, firstly, to the top of the recovery vessel 8 by means of a solenoid valve 98 and, secondly, to the source pressure by means of a solenoid valve 94 and to the discharge pressure (the atmosphere for example) by a solenoid valve 91. As for the filling of the viscosimeter, it is done according to the description given in the published French patent No. 2 652 540.

According to the invention, the circuit for the supply of ink to the printer comprises an electronically controlled pressure regulator as described here above, the transfer volume 4 of which contains a small quantity of ink and a volume of gas 40. The lower part of the transfer volume 4 is connected, firstly, to the base of the viscosimeter 9 by means of a solenoid valve 13 permitting the transfer of ink from the viscosimeter to the volume 4 and, secondly, to the base of the accumulating chamber 5 by a solenoid valve 15, permitting the transfer of ink from the volume 4 to the accumulating chamber, these two solenoid valves 13 and being electronically controllable. Furthermore, the upper part of the transfer volume 4 is connected to the pressure source 14 by the solenoid valve 1, to a depression source such as the atmosphere by the solenoid valve 2 and to the gas volume 50 of the accumulating chamber 5 by means of the solenoid valve 3.

The pressure prevailing in the accumulating chamber is measured by a pressure sensor 6, with an analog output for example.

The dimensions $V_4$ of the transfer volume 4 are such that they respond to the following adiabatic relationship (A):

$$P_5 \times V_5^y + P_4 \times V_4^y = P \times (V_5 + V_4)^y \qquad (A)$$

where $P_5$ is the absolute pressure in the accumulating chamber 5;

$V_5$ is the volume of the gas volume 50 in the accumulating chamber 5;

$P_4$ is the absolute pressure in the transfer volume 4;

$V_4$ is the volume of the gas volume 40 of the transfer volume 4;

P is the pressure after the volume 4 and the accumulating chamber 5 have been placed in a state of communication;

y is the coefficient of adiabicity.

This relationship (A) enables the computation of the volume $V_4$ on the basis of knowledge of the values of $P_4$, $P_5$, $V_5$ and the precision r of the regulator, as given by the formula:

$$r = \frac{P_5 - P}{P_5}$$

During the normal mode of operation of the printer, while the accumulating chamber 5 sprays a continuous jet to the printer head, the operating cycles of the pressure regulator, described with reference to FIGS. 2A and 2B, enable very high-precision control over the pressure of the ink ejected and hence enable the speed of the ink jet to be servocontrolled in order to improve the quality of the printing.

Thus, the invention also relates to a method for the regulation of the pressure of the ink contained in the accumulating chamber 5, comprising the following three cycles.

A first cycle for maintaining the pressure in the accumulating chamber 5, when said accumulating chamber is truly within the range of values chosen for efficient operation of the printing head, comprises elementary transfers of quantities of ink from the transfer volume 4 to the accumulating chamber 5 by means of the solenoid valve 15.

A second cycle to increase said pressure in the accumulating chamber 5, when it is below the chosen range, comprises the following steps:

a first step to increase the pressure $P_4$ in the transfer volume 4 through the placing, by activation, of its gas volume 40 in a state of communication with the pressure source 14 by means of the solenoid valve 1, the solenoid valves 1 and 2 remaining closed;

a second step for the isolation of the transfer volume 4 by the closing of all the solenoid valves;

a third step for placing the gas volume 40 of the transfer volume 4 in a state of communication with the gas volume 50 of the accumulating chamber 5 by the activated opening of the solenoid valve 3, the solenoid valves 1 and 2 remaining closed;

a fourth step for the taking into account, the solenoid valves being closd, of the pressure signal of the sensor 6 by means of the electronic control system, to restart this second cycle until the desired pressure is obtained in the accumulating chamber 5;

A third cycle to reduce the pressure in the accumulating chamber 5, when it is above the chosen range, comprises:

a first step to reduce the pressure $P_4$ through the placing, by activation, of the gas volume 40 in a state of communication with a pressure well (the atmosphere for example) by means of the solenoid valve 2, the solenoid valves 1 and 3 being closed;

a second step for the isolation of the volume 4 by the closing of all three solenoid valves 1 to 3;

a third step for placing the gas volume 40 of the transfer volume 4 in a state of communication with the gas volume 50 of the accumulating chamber 5 by means of the solenoid valve 3, the other two remaining closed;

a fourth step, the solenoid valves 1 to 3 being closed, for the taking into account of the signal put out by the pressure sensor 6 by means of the electronic control system, to restart this third cycle until the desired pressure is obtained in the accumulating chamber 5.

It will also observed, in the hydraulic diagram of FIG. 3, that the circuit for the addition of ink and solvent comprises a single circulation channel 102 for the ink and the solvent, thus limiting the problems of the clogging of the tubes by ink, and that the additions take place by the lower parts of the containers in order to avert the phenomena of disturbance of the unoccupied surfaces. Finally, we may note the role of a solvent transfer volume played by the viscosimeter, with the purpose of achieving the rinsing of the printing head during the periods when it stops.

The cycles of operation of the regulator can be used to obtain a servocontrol of the printer head jet speed. FIG. 4 is a diagram showing the principle of the servocontrol of the speed of the jet. This closed loop servocontrol system receives, firstly, a desired value of the speed of the jet $V_c$ (20 m/s for example) and, secondly, a measurement of the speed $V_j$ at the outlet of the accumulating chamber, carried out by a system described in the U.S. Pat. No. 5,160,939 filed on behalf of the Applicant. A comparator 16 takes the difference between the instructed value speed $V_c$ and the measured speed of the jet $V_j$, this difference being of the order of 0.3 m/s for example. This difference, called the error E, is then compared with a value δ, which is the error permitted, for example 0.2 m/s. The precision of the servocontrol is therefore obtained directly by computing the ratio between the permitted error δ and the desired value of the speed (0.2/20=1%).

Should the error E be greater than (+δ), the jet speed is considered to be too low, and it is therefore necessary to launch the second cycle of the regulator, called the cycle 2 in the figure, to increase the pressure of the accumulating chamber. Thus, the upper part of the accumulating chamber 5 is placed in a state of communication, by the solenoid valve 3, with the gas pocket 40 of the transfer volume 4, in which an overpressure has been set up beforehand by means of the prior opening of the solenoid valve 1.

Should the error E be smaller than (−δ), the jet speed is higher than the desired value speed $V_c$, and it is then necessary to activate the third cycle of operation of the regulator, called cycle 3 in the figure, to reduce the pressure in the accumulating chamber 5.

To this end, the upper part of the accumulating chamber 5 is put into a state of communication with the atmosphere by means of the solenoid valve 2, which permits a removal of gas from the accumulating chamber into the open air.

Should the error E be between (+δ) and (−δ), the regulator is allowed to work without any change being made in the pressure in the accumulating chamber.

The stability of the servocontrol is obtained by setting the size of the transfer volume 4 in such a way that the pressure disturbance in the accumulating chamber 5, due to the second and third cycles of operation of the regulator, does not make the jet speed vary by more than the value δ. Furthermore, the volume $V_4$ of the gas volume 40 of the transfer volume 4 must be kept in a constant ratio with the volume $V_5$ of the gas volume 50 of the accumulating chamber 5: this must be achieved by placing these two containers 4 and 5 in a permanent state of communication by means of the solenoid valve 15, outside the sequences for the adding and removal of gas to and from the accumulating chamber 5, as well as outside the ink transfer sequences as described hereinafter.

During the transient operational mode for the filling of the accumulating chamber 5, corresponding to the speedy transfer of ink from the viscosimeter 9 to the accumulating chamber 5, the level of regulation of the pressure in the accumulating chamber is obtained from information elements that are delivered no longer by the ink jet speed sensor but by the pressure sensor 6. The desired pressure value then results from the last measurement preceding the sequence for the transfer of the ink from the viscosimeter 9 to the accumulating chamber 5.

FIG. 5 is a diagram showing the principle of the transfer of ink to the accumulating chamber, according to the invention. This transfer must be done by making only a slight disturbance in the pressure prevailing in the accumulating chamber 5, in accordance with the precision of the speed servocontrol. This transfer sequence uses the transfer volume 4, the lower part of which is filled with ink, to make an elementary quantity of ink go from the viscosimeter 9 to the accumulating chamber 5.

To this end, the upper part of the viscosimeter 9, which contains a gas volume 90, is connected to the pressure source by an electronically controlled solenoid valve 17.

The lower part containing the ink is connected to the lower part of the transfer volume 4, which itself also contains ink, by means of the solenoid valve 13 through a filter 18. Then, with this solenoid valve 13 being closed again, the ink from the transfer volume 4 goes into the bottom of the accumulating chamber 5 by the opening of the solenoid valve 15. FIG. 6 shows the basic sequence of operation of the solenoid valves 1, 2, 3, 13, 15 and 17 during the transfer of the ink by means of the opening of said solenoid valves. The following step, where the solenoid valves 15 and 3 are open simultaneously, corresponds to the balancing, by means of communicating vessels, of the levels of ink of the accumulating chamber 5 and the transfer volume 4. The emptying of the viscosimeter calls for several transfer sequences, about ten of them, each followed by a verification of the speed of the jet. Corrections may be planned in case of need.

A regulator according to the invention has been tried out on a continuous ink-jet printer. In steady operating mode, to maintain the jet speed with a precision of within ±1%, the ink consumption of the printer is such that a pressure increasing cycle is necessary every twenty seconds; a pressure lowering cycle does not appear while occurrences of the pressure maintaining cycle constitute a broad majority of cases.

What is claimed is:

1. An electronically controlled pressure regulator for regulating a pressure of a diphasic fluid contained in an accumulating chamber between a higher pressure delivered by a pressure source and a lower discharge pressure delivered by a pressure well, the regulator comprising:

a first solenoid valve;

a transfer volume filled with gas connected to an upper volume of gas of the diphasic fluid of the accumulating chamber by the first solenoid valve;

a second solenoid valve connecting the transfer volume to the pressure source;

a third solenoid valve connecting said transfer volume to the pressure well;

a pressure sensor operably connected to said accumulating chamber and measuring a fluid pressure in said accumulating chamber; and an electronic control system connected to said pressure sensor and controlling said first, second and third solenoid valve dependent on the fluid pressure sensed by said pressure sensor.

2. A pressure regulator according to claim 1, wherein dimensions of the transfer volume are a function of the pressure source, the discharge pressure and the pressure to be regulated, and wherein said dimensions are lower than those of the accumulating chamber.

3. An electronically controlled pneumatic pressure regulator for regulating a pressure of a liquid contained in an accumulating chamber between a higher pressure delivered by a pressure source and a lower discharge pressure delivered by a pressure well, said pressure of liquid being given by a volume of gas lying over said liquid, and said accumulating chamber being connected to a container of liquid, the regulator comprising:

first, second, third, fourth, and fifth solenoid valves;

a transfer volume containing a small quantity of said liquid and a volume of gas connected to the volume of gas of the accumulating chamber by said first solenoid valve, said transfer volume having a lower part connected firstly to said container of liquid by said fourth solenoid valve and, secondly, to a lower part of said accumulating chamber by said fifth solenoid valve; and wherein:

said second solenoid valve connects said volume of gas of the transfer volume to the pressure source;

said third solenoid valve connecting said volume of gas of the transfer volume to the pressure well; and further comprising:

a pressure sensor operably connected to said accumulating chamber and measuring a fluid pressure in said accumulating chamber and measuring a pressure of the gas in the accumulating chamber; and an electronic control system connected to said pressure sensor and controlling said first, second, third, fourth, and fifth solenoid valves dependent on the fluid pressure sensed by said pressure sensor.

4. A pressure regulator according to claim 3, wherein dimensions of the transfer volume are a function of the pressure source, the discharge pressure and the pressure to be regulated, and wherein said dimensions are lower than those of the accumulating chamber.

5. A method for the regulation of a pressure of a diphasic fluid contained in an accumulating chamber, between a higher pressure delivered by a pressure source and a lower discharge pressure well, wherein said method comprises the following steps:

obtaining a measured value dependent on the pressure of the fluid in the accumulating chamber, while keeping closed a first solenoid valve connecting a transfer volume filled of gas to an upper volume of gas of the diphasic fluid of the accumulating chamber, a second solenoid valve connecting the transfer volume to the pressure source, and a third solenoid valve connecting the transfer volume to the pressure well; and controlling said first, second and third solenoid valves according to said measured value, in order to initiate one of the following cycles:

a first cycle for maintaining the pressure in the accumulating chamber when the measured value belongs to a range of values by closing the first, second and third solenoid valves;

a second cycle for increasing the pressure in the accumulating chamber when the measured value is lower than the predetermined range of values, said second cycle comprising:

a first step for increasing a pressure in the transfer volume by placing said volume in communication with the pressure source, by opening the second solenoid valve, the first and third solenoid valves being closed;

a second step for isolating the transfer volume by closing the first to third solenoid valves;

a third step for placing the transfer volume in a state of communication with the accumulating chamber, by opening the first solenoid valve, the second and third solenoid valves remaining closed;

a fourth step, with the first to third solenoid valves being closed, for again obtaining said measured value; and a third cycle for reducing the pressure in the accumulating chamber when the measured value is higher than the predetermined range of values, said third cycle comprising:

a first step, of placing the transfer volume in communication with the pressure well, by opening the third solenoid valve, the first and second solenoid valves remaining closed;

a second step, of isolating the transfer volume by closing the first to third solenoid valves;

a third step, of placing the transfer volume in a state of communication with the accumulating chamber by opening the first solenoid valve, the second and third solenoid valves remaining closed;

a last step, with the first, second and third solenoid valves being closed, for again obtaining said measured value.

6. A method for the regulation of a pressure of a liquid contained in an accumulating chamber, between a higher pressure delivered by a pressure source and a lower discharge pressure delivered by a pressure well, said pressure of liquid being given by a volume of gas lying over said liquid, and said accumulating chamber being connected to a container of liquid, wherein said method comprises the following steps:

obtaining a measured value dependent on the pressure of the liquid in the accumulating chamber, while keeping closed, a first solenoid valve connecting a volume of gas contained in a transfer volume to the volume of gas of the accumulating chamber, a second solenoid valve connecting the volume of gas contained in the transfer volume to the pressure source, a third solenoid valve connecting the volume of gas contained in the transfer volume to the pressure well, a fourth solenoid valve connecting a lower part of said transfer volume to said container of liquid, and a fifth solenoid valve connecting the lower part of the transfer volume to a lower part of said accumulating chamber; and controlling said first to fifth solenoid valves according to said measured value, in order to initiate one of the following cycles:

a first cycle for maintaining the pressure in the accumulating chamber, when the measured value is within a predetermined range of values, by closing the first to fourth solenoid valves;

a second cycle for increasing said pressure when the measured value is below the predetermined range of values, comprising:

a first step for increasing a pressure in the transfer volume by placing the volume of gas contained in said transfer volume in a state of communication with the pressure source by opening the second solenoid valve, the first and third solenoid valves remaining closed;

a second step for isolating the transfer volume by closing the first to fifth solenoid valves;

a third step for placing the volume of gas contained in the transfer volume in a state of communication with the gas volume contained in the accumulating chamber by opening the first solenoid valve, the second to fifth solenoid valves remaining closed;

a fourth step, with the first to third solenoid valves being closed, for obtaining said measured value; and a third cycle for reducing the pressure in the accumulating chamber, when the measured value is above the predetermined range of values, comprising:

a first step for reducing a pressure in the transfer volume by placing the volume of gas of the transfer volume in a state of communication with the pressure well by opening the third solenoid valve, the first, second, fourth and fifth solenoid valves being closed;

a second step for isolating the transfer volume by closing the first, second and third solenoid valves;

a third step for placing the volume of gas of the transfer volume in a state of communication with the volume of gas of the accumulating chamber by opening the first solenoid valve, the second solenoid valves remaining closed;

a fourth step, with the first, second, third, fourth solenoid valves being closed, for again obtaining said measured value.

7. A method according to claim 6, wherein said liquid is an ink provided for feeding a continuous jet printer head, a viscosity of said ink being measured in said container, containing a volume of gas lying over the ink, the volume of gas in said container being connected to the pressure source by a sixth solenoid valve, and wherein a transfer of ink into the accumulating chamber is made during the first cycle and comprises the following stages:

a first stage for transferring an elementary volume of ink from the container into the lower part of the transfer volume by opening the fourth solenoid valve, the first, second, third and fifth solenoid valves being closed;

a second stage for transferring the ink from the transfer volume into the accumulating chamber by opening the fifth solenoid valve, the first, second, third and fourth solenoid valves being closed;

a third stage for balancing ink levels in the accumulating chamber and in the transfer volume, by opening the first and fifth solenoid valves, the second, third and fourth solenoid valves being closed.

8. A method according to claim 7, wherein the volume of gas of the transfer volume is kept in a constant ratio with the volume of gas of the accumulating chamber by opening the fifth solenoid valve during the first cycle, when there is no transfer of ink into the accumulating chamber.

9. A method according to claim 8, for servocontrolling a speed of jet of the continuous liquid jet printer head, wherein the step of obtaining said measured value comprises the step of obtaining a measured value of a speed of the jet at an output of the printer head, and wherein the step of controlling said first to fifth solenoid valves includes:

calculating a difference E between a desired value of jet speed and said measured value;

comparing said difference E to a permitted value of error $\delta$;

initiating the first cycle when $-\delta<E<+\delta$ initiating the second cycle when $E>+\delta$; and initiating the third cycle when $E<-\delta$.

10. An electronically controlled pressure regulator for regulating a pressure of a diphasic fluid, the regulator comprising:

an accumulating chamber for holding the diphasic fluid at a pressure between a higher pressure delivered by a pressure source and a lower discharge pressure delivered by a pressure well:

a first solenoid valve;

a transfer volume filled with gas connected to an upper volume of gas of the diphasic fluid of the accumulating chamber by a first solenoid valve;

a second solenoid valve connecting the transfer volume to the pressure source;

a third solenoid valve connecting said transfer volume to the pressure well;

a pressure sensor operably connected to said accumulating chamber and measuring a fluid pressure in said accumulating chamber; and an electronic control system connected to said pressure sensor and controlling said first, second and third solenoid valves dependent on the fluid pressure sensed by said pressure sensor.

* * * * *